United States Patent [19]

Davies et al.

[11] 3,975,312

[45] Aug. 17, 1976

[54] DETERGENT COMPOSITIONS

[75] Inventors: James Francis Davies; Philip Alan Gilbert; Laurence Thompson, all of Wirral, England

[73] Assignee: Lever Brothers Company, New York, N.Y.

[22] Filed: May 16, 1974

[21] Appl. No.: 470,503

Related U.S. Application Data

[63] Continuation of Ser. No. 250,442, May 4, 1972, abandoned.

[30] Foreign Application Priority Data

May 12, 1971 United Kingdom ..... 14421/71

[52] U.S. Cl. ..... 252/535; 252/546; 252/554

[51] Int. Cl.[2] ..... C11D 3/34; C11D 3/065

[58] Field of Search ..... 252/535, 554, 546; 260/503, 513

[56] References Cited

UNITED STATES PATENTS

| | | | |
|---|---|---|---|
| 2,787,639 | 4/1957 | Sargent | 260/513 |
| 3,459,670 | 8/1969 | Carter | 252/99 |
| 3,519,054 | 7/1970 | Cavataio et al. | 159/48 |
| 3,676,340 | 7/1972 | Berg et al. | 252/8.75 |

FOREIGN PATENTS OR APPLICATIONS

| | | |
|---|---|---|
| 970,476 | 9/1964 | United Kingdom |

*Primary Examiner*—Mayer Weinblatt
*Attorney, Agent, or Firm*—James J. Farrell; Kenneth F. Dusyn; Melvin H. Kurtz

[57] ABSTRACT

A detergent composition incorporates a synthetic anionic, nonionic, amphoteric or zwitterionic detergent active compound and a water soluble or dispersible salt of an alkane ($C_{18}$–$C_{22}$)-1,2-sulphinic-sulphonic acid or an alkane ($C_{18}$–$C_{22}$)-1,2-disulphonic acid detergency builder. The ratio by weight of the detergent active compound to the detergency builder is preferably from about 3:1 to 1:10, for example from about 1:1 to 1:5.

5 Claims, No Drawings

DETERGENT COMPOSITIONS

This is a continuation of application Ser. No. 250,442, filed May 4, 1972, now abandoned.

The invention relates to detergent compositions, and in particular to detergent compositions adapted for fabric washing.

Detergent compositions, particularly those adapted for fabric washing, commonly incorporate synthetic detergent active compounds together with detergency builders. Conventional detergency builders are commonly inorganic materials, particularly condensed phosphates, for example sodium tripolyphosphate. It has, however, been suggested that the use of phosphate detergency builders can contribute to eutrophication problems. Alternative organic detergency builders which have been proposed, for example sodium nitrilotriacetate (NTA) and synthetic polyelectrolyte materials, tend to be more expensive or less efficient than the phosphate detergency builders, or otherwise unsatisfactory for one reason or another. For example NTA contains nitrogen which is alleged also to be a contributory factor in eutrophication and the synthetic polyelectrolyte builders proposed tend to be hygros opic and largely non-biodegradable.

According to the present invention a detergent composition incorporates a synthetic anionic, nonionic, amphoteric or zwitterionic detergent active compound and a water soluble or dispersible salt of an alkane ($C_{18}$–$C_{22}$)-1,2-sulphinic-sulphonic acid or an alkane ($C_{18}$–$C_{22}$)-1,2-disulphonic acid as the detergency builder.

In the compositions of the invention, the salts of the alkane sulphinic-sulphonic acids or disulphonic acids act as efficient detergency builders; this is believed to be due to their forming insoluble salts with calcium and magnesium ions present in hard water. Moreover, the use of these dianionic compounds as detergency builders can promote fabric softening properties.

The alkane sulphinate-sulphonates and disulphonates may be prepared by the addition to a $C_{18}$–$C_{22}$ olefin of 2 moles of bisulphite ion to form initially an alkane sulphinate-sulphonate, followed by oxidation to the disulphonate if desired. Suitable olefins are commercially available, for example by isolation from cracked paraffin distillate, or by synthesis, for example by the polymerization of ethylene using a Ziegler or like catalyst. Internal olefins can be used but they tend to react much more slowly than $\alpha$-olefins with the bisulphite. So-called vinylidene olefins, which are $\beta$-alkyl $\alpha$-olefins are unsuitable for use as they react only slowly to form a monosulphonate.

It is preferred to use linear $\alpha$-olefins with 18 carbon atoms for preparing the dianionic bisulphite addition products with optimum detergency building properties. With olefins having less than 18 carbon atoms the detergency building performance of the reaction product drops considerably as the calcium and magnesium salts tend to be more water-soluble, whilst with olefins of longer carbon chain length, particularly with more than 22 carbon atoms per molecule, the water-solubility of the alkali metal salts of the dianionic bisulphite addition products tend to decrease, which restricts their ease of use. Moreover, more of the compounds with longer alkyl chains tend to be required for equivalent detergency building.

The reaction of the olefins with bisulphite ions is normally conducted in solution, for example in aqueous alcoholic solution, at elevated temperatures. Any soluble bisulphite salt may be employed, for example the ammonium, sodium, triethanolamine, potassium, calcium and magnesium bisulphites, but the alkali metal bisulphites, especially sodium bisulphite, are preferred. Alternatively, bisulphite ion can be generated in situ by the addition of sulphur dioxide to an alkali metal hydroxide solution, if desired. The reaction is accomplished with a free radical initiating catalyst, such as an inorganic or organic peroxide or an organic perester, and preferably at elevated temperatures, and to improve the yield of the alkane-sulphinate-sulphonate it is essential to use an acid pH, preferably from about 3.5 to 5.0. The production of alkane sulphinic-sulphonic acids and their salts is more fully described in UK Patent Specification No. 970,476.

The product of the reaction, which contains predominantly the alkane sulphinate-sulphonate, may be isolated from the reaction medium by conventional techniques, for example by evaporation of the solvent. If it is desired to use the sulphinate-sulphonate based reaction product directly, it is preferable to add an anti-oxidant to suppress oxidation to the disulphonate during subsequent processing. If an alkane disulphonate is desired, it is necessary of course to oxidize the initial reaction product using for example hydrogen peroxide or sodium hypochlorite solution. This oxidation may be accomplished before or after isolation of the sulphinate-sulphonate. The product is usually a mixture of alkane sulphinate-sulphonate and disulphonates, due either to imcomplete oxidation to the latter, or to partial oxidation of the former during the reaction. The products are normally in salt form, with the same cations as the bisulphite employed in the reaction, but the cations can be exchanged using conventional techniques, if desired. The preferred salts of the alkane sulphinate-sulphonates and disulphonates are the alkali metal salts, especially the sodium salts.

The synthetic detergent active compounds which can be used in the compositions of the invention are preferably anionic detergent active compounds, which are readily available and relatively cheap, and mixtures thereof. These compounds are usually water-soluble alkali metal salts of organic sulphates and sulphonates having alkyl radicals containing from about 8 to about 22 carbon atoms, the term alkyl being used to include the alkyl portion of higher acyl radicals. Examples of such synthetic anionic detergent active compounds are sodium and potassium alkyl sulphates, especially those obtained by sulphating the higher ($C_8$–$C_{18}$) alcohols produced by reducing the glycerides of tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolyzing with a base to produce a random sulphonate; and olefin sulphonates, which term is used to cover the material made by reacting olefins, particularly alpha-olefins, with $SO_3$ and then neutralizing and hydrolyzing the reaction product.

If desired, nonionic detergent active compounds may also be used. Examples include the reaction products of alkylene oxides, usually ethylene oxide, with alkyl ($C_6$–$C_{12}$) phenols, generally 5 to 25 EO; i.e. 5 to 25 units of ethylene oxide per molecule; the condensation products of aliphatic ($C_8$–$C_{18}$) alcohols with ethylene oxide, generally 6 to 30 EO, and products made by condensation of ethylene oxide with the reaction products of propylene oxide and ethylenediamine. Other so-called nonionic detergent active compounds include long chain tertiary amine oxides, long chain tertiary phosphine oxides and dialkyl sulphoxides.

Mixtures of detergent active compounds, for example mixed anionic or mixed anionic and nonionic compounds may be used in the detergent compositions, particularly to impart thereto controlled low sudsing properties. This is particularly beneficial for compositions intended for use in suds-intollerant automatic washing machines. Mixtures of amine oxides and ethoxylated nonionic compounds can also be beneficial.

Many suitable detergent active compounds are commercially available and are described in the literature, for example in "Surface Active Agents and Detergents" by Schwartz, Perry and Berch.

Amounts of amphoteric or zwitterionic detergent active compounds can also be used in the compositions of the invention, but this is not normally desired due to their relatively high cost. If any amphoteric or zwitterionic detergent active compounds are used it is generally in small amounts in compositions based on the much more commonly used anionic or nonionic detergent active compounds.

The amount of the synthetic detergent active compound or compounds used is generally in the range of from about 10% to 50%, preferably about 15% to 30% by weight of the compositions, depending on the desired properties.

The amount of the water-soluble salt or salts of the alkane sulphinic-sulphonic or disulphonic acids is normally within the range of from about 15% to about 80%, preferably at least about 30% by weight depending on the desired properties of the composition. When the compositions are used at lower concentrations, for example in the range from about 0.05% to about 0.20% weight by volume, as is often the case in automatic domestic washing machines, such as are commonly used in North America, it is preferable to have higher amounts of the water soluble salts present, for example at least about 35% and preferably about 40% to 60% by weight. It is a benefit of the use as detergency builders of the alkane sulphinate-sulphonates or disulphonates that adequate detergency can be obtained under the low user concentrations commonly employed in North America.

The ratio by weight of the detergency builder to the detergent active compound in the compositions of the invention is normally from about 20:1 to about 1:20, and preferably from about 1:3 to 10:1, particularly from about 1:1 to 5:1 in fabric washing compositions.

Whilst it is possible to use the water-soluble salts of the alkane sulphinic-sulphonic or disulphonic acids as the sole detergency builders in detergent compositions, it is possible to have present amounts of other detergency builders. Examples of such materials include sodium nitrilotriacetate, sodium ethylene diamine tetraacetate, sodium alkenyl succinates, sodium salts of sulphonated fatty acids, sodium tripolyphosphate, sodium and potassium pyrophosphate, sodium orthophosphate, sodium carbonate and polyelectrolyte builders such as sodium polyacrylate, sodium polymaleate and sodium copolyethylene-maleate.

It is advantageous to use in the compositions of the invention an amount of an alkaline silicate, which tends to enhance the detergency of the compositions, particularly in waters containing significant proportions of magnesium salts. In this case the amount of alkaline silicate is preferably from about 6% to about 15% by weight.

In addition to the essential ingredients in the detergent compositions, other optional ingredients may be added, for example perfumes, colorants, fabric softening agents, fungicides, germicides, enzymes, fluorescent agents, anti-redeposition agents such as sodium carboxymethyl cellulose, hydrotropes, and in the case of liquid compositions opacifiers and organic solvents such as lower aliphatic alcohols. Other ingredients such as bleaches, for example sodium perborate with or without the presence of peracid precursors, chlorine-liberating bleach compounds and inorganic salts such as sodium carbonate, sodium sulphate and sodium chloride may also be present if desired. The compositions also usually contain amounts of water, for example in the range of from about 5 to 15% by weight in powdered detergent compositions.

The compositions of the invention may be solid compositions, for example in powdered, granular or tablet form, semi-solid paste or gel composition or they may be liquid compositions. The compositions can also be made by conventional processing techniques, for example by spray-drying aqueous slurries to give detergent powders. It may be advantageous in this case to use the process described in our Belgian Pat. No. 769,827 and corresponding patents, in which relatively mild conditions are used in the spray-drying tower and the slurry is made under pressure with a low water content. This decreases the fire hazard for making powders of high organic content.

Whilst the compositions are of particular utility in the field of fabric washing, they can also be used for general cleaning purposes and if desired for personal washing.

Detergent compositions according to the invention are illustrated by the Examples below, in all of which parts are by weight, except where otherwise indicated.

EXAMPLES 1 AND 2

Two detergent compositions were prepared by conventional spray-drying to the following formulations:-

| Ingredient | Percentage in each Example 1 | 2 |
|---|---|---|
| Sodium linear sec-alkyl benzene sulphonate (made from DOBS 055 alkyl benzene) | 20 | 20 |
| Disodium $C_{18}$ alkane-1,2-sulphinate-sulphonate[1] | — | 50 |
| Disodium $C_{18}$ alkane-1,2-disulphonate[1] | 50 | — |
| Alkaline silicate | 8 | 8 |
| Sodium carboxymethylcellulose | 0.5 | 0.5 |

-continued

| Ingredient | Percentage in each Example 1 | 2 |
|---|---|---|
| Fluorescent agent | 1.0 | 1.0 |
| Sodium sulphate | 15.5 | 15.5 |
| Water to | 100 to | 100 |

[1]Impure mixtures prepared as described below.

The disodium $C_{18}$ alkane-1,2-sulphinate-sulphonate was prepared by charging $C_{18}$ $\alpha$-olefin (250 parts), isopropanol (364 parts) and water (171 parts) to a reaction vessel and heating to reflux temperature. Gaseous sulphur dioxide was bubbled into the reaction mixture to lower the pH to 3.0 and sodium bisulphite solution (sodium metabisulphite (187.5 parts) in water (375 parts) at pH less than 5.0) was added progressively to maintain a single phase reaction mixture and tert-butyl perbenzoate (0.04 mole) was added at intervals in 1 mole per cent amounts. When the reaction was complete the pH was raised to 10.5 by the addition of sodium hydroxide solution and the bulk of the isopropanol was removed by distillation. Part of the reaction product, which contained about 35% of mixed alkane sulphinate-sulphonate and alkane disulphonate of which 78.0% (27.4% on the reaction product) was alkane sulphinate-sulphonate, was used directly in the detergent composition of Example 1, with 1% of di-t-butyl-p-cresol added to prevent further oxidation.

The remainder of the alkane sulphinate-sulphonate was further oxidized to the disulphonate with sodium hypochlorite. This was accomplished by charging the previous reaction product (244 parts) to a jacketed reactor at 40°C and adding sodium hypochlorite solution (100 parts, 10.3% $Cl_2$) in small amounts over 1 hour to keep the temperature at 40°–45°C, whilst cooling water was circulated through the jacket to control the exothermic reaction. The reaction product, which contained about 26% of mixed alkane sulphinate-sulphonate and alkane disulphonate of which 54.2% (14.1% on the reaction product) was the original alkane disulphonate, was used directly in the production of the composition of Example 2.

The detergent compositions were evaluated in comparison with a conventional commercially-available sodium tripolyphosphate-based detergent composition containing 40% sodium tripolyphosphate, 16% sodium linear sec-alkyl benzene sulphonate, 5% alkaline silicate and the usual fluorescent agent and anti-redeposition additives. The tests were conducted with naturally-soiled halved tea towels, pillow cases and towels in domestic automatic washing machines using 0.1% product concentrations in water of 18°French hardness (Ca:Mg, 2:1) at 50°C.

In the test for determining the detergencies of the products, the washed halved articles were assessed for appearance by a panel of skilled assessors who decided that the product of Example 2 was significantly better than, and the product of Example 1 was equivalent to, the comparative sodium tripolyphosphate-based product for fabric washing efficiency. It was also noticed that the products of the Examples gave particularly stable lathers which did not collapse before the end of the wash cycles as happened to the lather of the comparative product.

The feel of each of the halved articles washed in the different products was assessed by a panel of 20 housewives, after 1 wash cycle and after 10 wash cycles, when it was decided that articles washed using the product of Example 1 felt significantly softer than those washed in the comparative sodium tripolyphosphate-based product after both 1 and 10 washes, whilst using the product of Example 2 gave equal fabric softness after 10 washes.

Samples of the fabrics washed with the compositions of the Examples, after 1,5 and 10 wash cycles, were tested for any inorganic ash build-up, when it was found that the ash level after 10 washes was only 0.21%, which is not excessive and is comparable with the usual negligible ash deposition figures for conventional sodium tripolyphosphate based products.

The soil anti-redeposition properties of the products of the Examples were also determined by washing samples of various clean fabrics with the soiled halved articles and determining the extent of soiling of the clean fabrics over a number of wash cycles. It was found that soil redeposition on polyester (Crimplene) fabric and Dacron polyester/cotton fabrics were less with both products of Examples 1 and 2 than with the comparative product, whereas with other fabrics including cotton sheeting, terry towelling and nylon fabrics the soil redeposition properties of the compositions were similar.

EXAMPLE 3

In order to assess the detergencies of alkane sulphinate-sulphonate and disulphonates of various chain lengths a series of detergent compositions were prepared to the following formulation:

| Ingredient | % |
|---|---|
| Sodium linear sec-alkyl benzene sulphonate | 16 |
| Disodium alkane sulphinate-sulphonate or disulphonate | 50 |
| Alkaline silicate | 8 |
| Water to | 100 |

For this example, the alkane sulphinate-sulphonates used were made by the following procedure: sodium metabisulphite (190 g, 2 moles) was dissolved in water (400 ml) and isopropanol (400 ml). The olefin (1 mole), for example $C_{20}$ $\alpha$-olefin (280 g), and t-butyl perbenzoate (2 ml, 0.01 mole) were added to the solution and the mixture was stirred and heated to reflux for 5–6 hrs, maintaining the pH at about 4 by the addition of gaseous sulphur dioxide. When the reaction was completed, as evidenced by the steady low pH, the bulk of the isopropanol was removed by distillation to leave an aqueous solution of the alkane sulphinate-sulphonate containing about 35% of the latter, which was used directly in the production of the detergent compositions. When the alkane disulphonate was wanted, the solution of the alkane sulphinate-sulphonate prepared as above was diluted to about 2 liters with water and oxidation was accomplished using an alkaline (ammoniacal) solution of 30 volumes hydrogen peroxide in a 1.5:1 molar excess.

The detergencies of the several compositions were determined at varying product concentrations under standard conditions, with a standard cotton test cloth soiled with a radioactive-labelled synthetic sebum, in water of 18°French hardness (Ca:Mg, 2:1) at 50°C. The results are given in Table I below which includes the comparative results using sodium tripolyphosphate as the detergency builder instead of the alkane sulphinate-sulphonate or disulphonate. The % detergency is calculated as the % reduction in the radio-activity of the test cloth.

TABLE I

| Detergency Builder | % Detergency at different product concentrations 0.05 | 0.075 | 0.1 | 0.125 | 0.15 | 0.2 | 0.3 |
|---|---|---|---|---|---|---|---|
| Sodium $C_{12}$ alkane-1,2-disulphonate | 15.1 | 12.0 | 11.8 | 15.2 | 24.6 | 22.5 | 41.6 |
| Sodium $C_{14}$ alkane-1,2-disulphonate | 9.8 | 25.8 | 21.8 | 23.2 | 28.0 | 35.3 | 47.3 |
| Sodium $C_{16}$ alkane-1,2-disulphonate | 8.2 | 20.1 | 22.2 | 27.6 | 30.8 | 40.1 | 55.6 |
| Sodium $C_{18}$ alkane-1,2-disulphonate | 25.7 | 36.6 | 42.5 | 55.0 | 61.2 | 79.5 | — |
| Sodium $C_{20}$ alkane-1,2-disulphonate | 49.3 | 48.8 | 50.5 | 63.9 | 71.8 | 81.4 | 86.5 |
| Sodium $C_{18}$ alkane-1,2-sulphinate-sulphonate | 15.5 | 25.7 | 39.6 | 41.3 | 51.8 | 64.9 | — |
| Sodium tripolyphosphate | 10.8 | 19.8 | 40.0 | — | 68.7 | 78.6 | 86.3 |

These results show the builders with $C_{18}$ and $C_{20}$ alkane radicals to be very good detergency builders which are generally equivalent to sodium tripolyphosphate and significantly better at lower product concentrations. Two of the latter compositions were then evaluated for detergency using an alternative Terg-O-Tometer test using a standard Dacron polyester/cotton test cloth soiled with vacuum cleaner dust. The results were as shown in Table II below:

TABLE II

| Detergency Builder | % Detergency at different product concentrations 0.05 | 0.075 | 0.10 | 0.15 | 0.20 |
|---|---|---|---|---|---|
| Sodium $C_{18}$ alkane-1,2-sulphinate-sulphonate | 25.8 | 34.6 | 54.0 | 57.1 | 59.4 |
| Sodium $C_{20}$ alkane-1,2-disulphonate | 30.6 | 35.8 | 42.5 | 58.0 | 62.7 |
| Sodium tripolyphosphate | 26.3 | 44.5 | 56.8 | 63.7 | 63.9 |

These results show the detergent compositions of the invention to be generally equivalent to the conventional sodium tripolyphosphate-based product with a particulate soil.

EXAMPLE 4

To show the detergency building effect of an alkane disulphonate according to the invention three compositions were prepared as follows, two comparative compositions A and B containing only a detergent active compound or the builder alone.

| Ingredient | % in Composition Example 4 | A | B |
|---|---|---|---|
| Sodium secondary linear alkyl ($C_{10}$–$C_{15}$) benzene sulphonate | 20 | 20 | — |
| Disodium alkane ($C_{18}$)-disulphonate | 30 | — | 30 |
| Water | to 100 | to 100 | to 100 |

These compositions were tested for detergency in a Terg-O-Tometer under standard conditions at 50°C and pH 9.5, using a product concentration of 0.1% in either demineralized water (°H) or water or 18°French hardness (Ca:Mg, 2:1). With either a 65% "Dacron" polyester/35% cotton test cloth soiled with vacuum cleaner dust (VCD) or a commercially available cotton test cloth (EMPA101), the detergency results were as follows:

| Soft Water | Composition | % Detergency VCD | EMPA 101 |
|---|---|---|---|
| | 4 | 37.6 | 51.2 |
| | A | 45.3 | 46.5 |
| | B | 21.7 | 37.9 |
| Hard Water | 4 | 26.4 | 21.5 |
| | A | 9.2 | 8.3 |
| | B | 12.5 | 12.8 |

These results show a strong detergency building effect for the alkane disulphonate in hard water, but in soft water the effect is less marked and there appears to be a slight antagonistic effect with the detergent active compound in soft water using the VCD test cloth.

EXAMPLES 5 AND 6

A further series of detergent compositions were prepared with or without a detergent active compound and with either one or both of an alkane di-sulphonate and sodium tripolyphosphate as detergency builders. The formulations for the two examples 5 and 6 and for comparative products C to F were as follows:

| Ingredient | % in composition C | D | E | F | 5 | 6 |
|---|---|---|---|---|---|---|
| Sodium linear secondary alkyl ($C_{10}$–$C_{15}$) benzene sulphonate | 20 | 20 | — | — | 20 | 20 |
| Disodium alkane ($C_{18}$) disulphonate | — | — | 30 | 30 | 30 | 30 |
| Sodium tripolyphosphate | — | 10 | — | 10 | — | 10 |
| Water | | | to 100 | | | |

These compositions were tested for detergency using the same procedure and test cloths as in Example 4 (with hard water) with the following results:

| Compositions | % detergency VCD | EMPA 101 |
|---|---|---|
| C | 8.0 | 7.9 |
| D | 11.0 | 10.3 |
| E | 14.1 | 10.6 |
| F | 8.1 | 10.1 |
| 5 | 36.2 | 29.3 |
| 6 | 36.8 | 27.7 |

These results show clearly the detergency building effect of the alkane disulphonate with and without the extra sodium tripolyphosphate.

EXAMPLES 7 TO 36

A series of detergent compositions were prepared using different detergent active compounds and differing amounts of an alkane disulphonate detergency builder or for comparative purposes sodium tripolyphosphate, as follows:

| Ingredient | % in composition 7 | 8 | 9 | 10 | 11 | Comparative G |
|---|---|---|---|---|---|---|
| Sodium alkyl ($C_{10}$–$C_{15}$) benzene sulphonate | 16 | 16 | 16 | 16 | 16 | 16 |
| Disodium alkane ($C_{18}$) disulphonate | 10 | 20 | 35 | 45 | 60 | — |
| Sodium tripolyphosphate | — | — | — | — | — | 50 |
| Sodium alkaline silicate | 5 | 5 | 5 | 5 | 5 | 5 |
| Water | | | | | to 100 | |

Further Examples 12 to 16, 17 to 21, 22 to 26, 27 to 31 and 32 to 36, comparatives H, I, J, K and L, were prepared, respectively, by replacing the sodium alkyl benzene sulphonate with sodium alkyl ($C_{14}$–$C_{15}$) sulphate, secondary alkyl ($C_{11}$–$C_{15}$)-9EO condensate, sodium alkyl ($C_{12}$–$C_{15}$)-3EO sulphate, sodium olefin ($C_{14}$) sulphonate and sodium alkane ($C_{16}$) sulphonate.

The compositions were tested for detergency using the test conditions as described for Example 4 except that the water used was of 9°French hardness (Ca:Mg, 2:1) and the test cloth was of cotton poplin soiled with 4 parts of fatty soil and egg albumin and 1 part of particulate soil. The detergency test results were as follows:

| Composition | % Detergency | Composition | % Detergency |
|---|---|---|---|
| 7 | 44.5 | 22 | 78.2 |
| 8 | 71.2 | 23 | 80.2 |
| 9 | 82.0 | 24 | 87.5 |
| 10 | 81.0 | 25 | 87.0 |
| 11 | 84.5 | 26 | 83.0 |
| G | 87.0 | J | 83.0 |
| 12 | 78.7 | 27 | 72.8 |
| 13 | 77.0 | 28 | 82.0 |
| 14 | 86.1 | 29 | 84.0 |
| 15 | 83.2 | 30 | 81.8 |
| 16 | 81.0 | 31 | 86.1 |
| H | 81.8 | K | 76.1 |
| 17 | 78.1 | 32 | 54.2 |
| 18 | 77.9 | 33 | 74.1 |
| 19 | 84.5 | 34 | 74.1 |
| 20 | 86.0 | 35 | 82.0 |

-continued

| Composition | % Detergency | Composition | % Detergency |
|---|---|---|---|
| 21 | 83.8 | 36 | 79.0 |
| I | 80.9 | L | 80.8 |

These results show that the alkane disulphonate is roughly comparable in detergency building properties with sodium tripolyphosphate. It is also seen that the improvement in detergency is enhanced when using a detergent active compound which forms an insoluble calcium salt.

What is claimed is:

1. A detergent composition for fabric washing comprising a synthetic anionic, nonionic, amphoteric or zwitterionic detergent active compound and a detergency builder which forms insoluble calcium and magnesium salts and is selected from the group of water soluble and dispersible alkali metal salts of alkane ($C_{18}$–$C_{22}$)-1,2-sulphinic-sulphonic acids and alkane ($C_{18}$–$C_{22}$)-1,2- disulphonic acids, the amount of the detergent active compound being from about 10% to 50% by weight of the composition, and the ratio by weight of the detergent active compound to the detergency builder being from about 3:1 to 1:10.

2. A detergent composition according to claim 1, comprising an additional detergency builder selected from the group of sodium nitrilotriacetate, sodium ethylene diamine tetraacetate, sodium tripolyphosphate, sodium pyrophosphate, potassium pyrophosphate, sodium orthophosphate and sodium carbonate.

3. A detergent composition according to claim 1, wherein the ratio by weight of the detergent active compound to the detergency builder is from about 1:1 to 1:5.

4. A detergent composition according to claim 1, wherein the detergency builder is used in the form of the sodium salt.

5. A detergent composition according to claim 1, wherein the detergency builder is a salt of an alkane ($C_{18}$) sulphinic-sulphonic or disulphonic acid.

* * * * *